US007152583B2

(12) United States Patent
Abe et al.

(10) Patent No.: US 7,152,583 B2
(45) Date of Patent: Dec. 26, 2006

(54) HIGH-PRESSURE FUEL PUMP

(75) Inventors: Masami Abe, Hitachi (JP); Hiroyuki Yamada, Hitachinaka (JP); Toru Onose, Higashiibaraki (JP); Atsuji Saito, Hitachinaka (JP); Satoshi Usui, Hitachinaka (JP); Masayoshi Kotaki, Hitachinaka (JP); Hiroshi Odakura, Hitachiota (JP)

(73) Assignees: Hitachi, Ltd., Tokyo (JP); Hitachi Car Engineering Co., Ltd., Hitachinaka (JP)

( * ) Notice: Subject to any disclaimer, the term of this patent is extended or adjusted under 35 U.S.C. 154(b) by 316 days.

(21) Appl. No.: 10/442,203

(22) Filed: May 21, 2003

(65) Prior Publication Data

US 2003/0219346 A1 Nov. 27, 2003

(30) Foreign Application Priority Data

May 24, 2002 (JP) ..... 2002-149949

(51) Int. Cl.
*F02M 37/04* (2006.01)

(52) U.S. Cl. ..... 123/446; 123/456; 123/495

(58) Field of Classification Search ..... 123/458, 123/456, 495, 514, 179.17, 446, 506
See application file for complete search history.

(56) References Cited

U.S. PATENT DOCUMENTS 6,058,912 A * 5/2000 Rembold et al. ..... 123/516
6,131,549 A * 10/2000 Onishi ..... 123/495
6,345,608 B1 * 2/2002 Rembold et al. ..... 123/506
6,688,291 B1 * 2/2004 Onishi et al. ..... 123/506
6,729,286 B1 * 5/2004 Onishi et al. ..... 123/90.48
2002/0157646 A1 * 10/2002 Hiraku et al. ..... 123/456

FOREIGN PATENT DOCUMENTS

| | | |
|---|---|---|
| DE | 19959202 | 7/2001 |
| EP | 0950810 | 10/1999 |
| EP | 1251266 | 10/2002 |
| EP | 1273835 | 1/2003 |
| JP | 2001-055961 | 2/2001 |
| JP | 2001-123912 | 5/2001 |

OTHER PUBLICATIONS

European Search Report dated Jan. 26, 2006.

* cited by examiner

*Primary Examiner*—Carl S. Miller
(74) *Attorney, Agent, or Firm*—Crowell & Moring LLP

(57) ABSTRACT

A simple structured high-pressure fuel pump.

A fuel pump comprises a reciprocably-supported cylinder, a pressurizing chamber using part of the outer surface of the cylinder as the wall surface which move to change the internal volume, a fuel intake passage forming a fuel passage which introduces fuel to the pressurizing chamber, a fuel discharge passage for the compressed fuel coming out from the pressurizing chamber. A fuel intake valve is provided in fuel intake passage. A fuel discharge valve is provided in said fuel discharge passage. A connecting passage connects upstream side of the intake valve in the fuel intake passage and the downstream side of it. A check valve which flows fuel from the fuel discharge flow passage to the fuel intake passage is provided in the connecting passage.

18 Claims, 9 Drawing Sheets

A SECTIONAL VIEW

HIGH-PRESSURE FUEL PUMP

BACKGROUND OF THE INVENTION

1. Field of the Invention

This invention relates to a fuel pump.

2. Prior Art

Japanese Application Patent Laid-Open Publication No. 2001-55961 discloses a fuel supplying system equipped with a throttle member for dampening pulsation of high-pressure fuel in a high-pressure fuel discharge passage in the downstream side of a branch in a branch passage which contains a high-pressure regulator. The internal pressure of the high-pressure fuel supply system is determined by the high-pressure regulator. This invention can make the service lives of the high-pressure fuel pump and the cam shaft longer and reduce the operating pressure range of the high-pressure damper without increasing the internal pressure of the high-pressure fuel supply system due to a pressure loss.

SUMMARY OF THE INVENTION (Problems to be Solved by the Invention)

The invention disclosed by Japanese Application Patent Laid-Open Publication No. 2001-55961 requires an exhaust pipe between the high-pressure regulator and the fuel tank. This makes the fuel supply system complicated and raises its production cost.

An object of the present invention is to provide a high-pressure fuel pump of a simpler structure.

(Means for Solving the Problems)

To accomplish the above object, the present invention makes the fuel intake passage and the discharge passage close to each other in the fuel pump, provides a passage to connect these passages, and further provides a relief valve in this connecting passage. This can keep the fuel pump compact and omit a pipe in the engine.

The fuel pump can preferably be made compacter by placing the fuel intake passage and the discharge passage in parallel, providing a passage perpendicular to these passages to connect them with each other, and providing a relief valve in the connecting passage.

Figure 1:
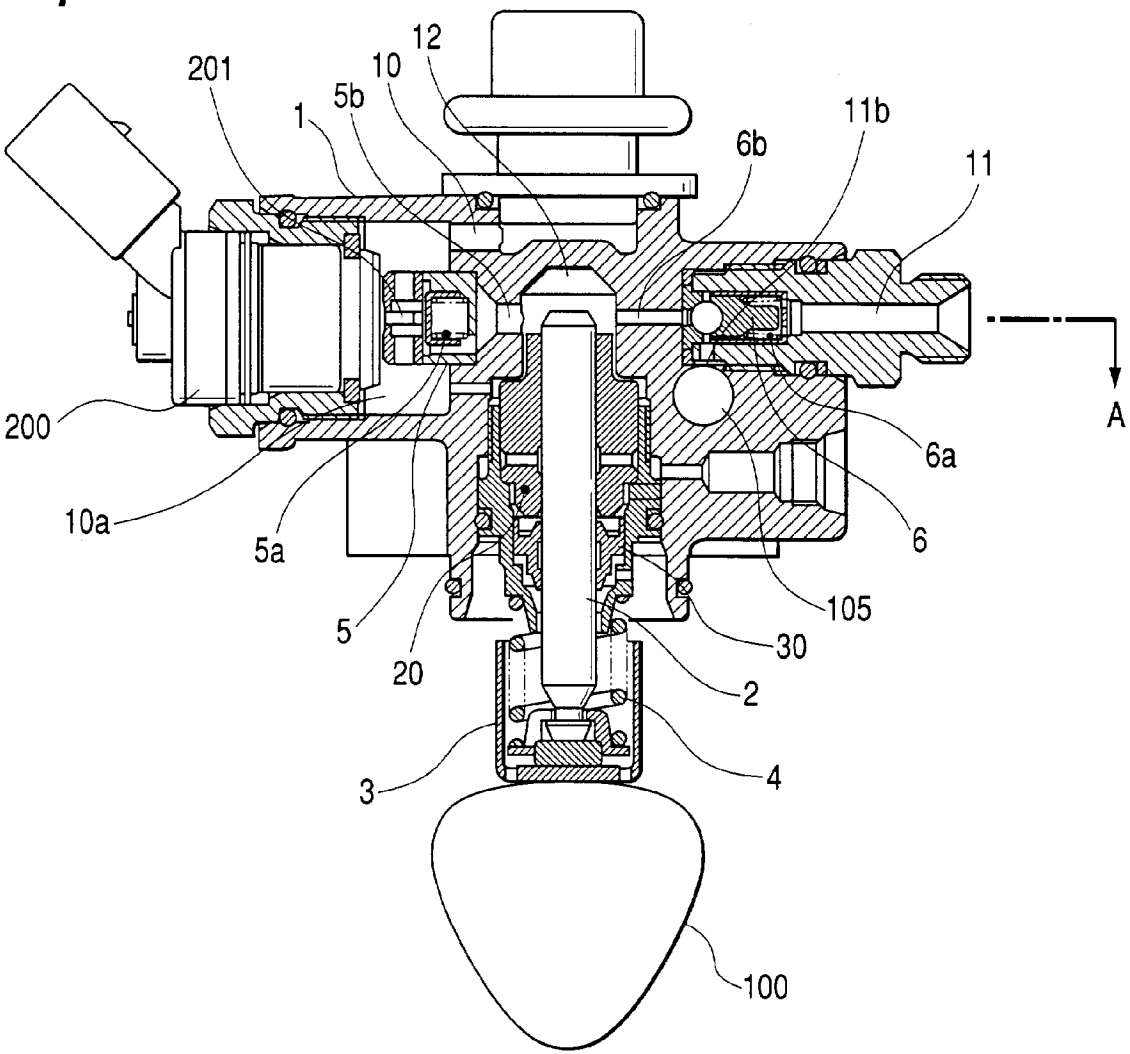
FIG. 1 is a vertical sectional view of a fuel pump which is one embodiment of the present invention.

DETAILED DESCRIPTION OF THE INVENTION (Description of the Preferred Embodiments)

We inventors studied and examined the high-pressure fuel pumps from all angles. The pump is equipped with a mechanism for regulating a rate of the discharged fuel. The fuel pump is controlled so that, in the normal operation, an optimal quantity of fuel may be fed to the engine. The accumulator receives fuel from the fuel pump and sends fuel to the combustion chamber of the engine through a fuel injection valve. This composition enables balancing of the fuel discharge rate of the fuel pump and the fuel injection rate of the fuel injection valve, and controlling of the fuel pressure in the accumulator. This accumulator is also equipped with a relief valve. The opening pressure of the relief valve is made higher than the target maximum fuel pressure in the normal operation. The relief valve opens to flow fuel from the accumulator to the fuel intake passage only when the fuel pressure is going to go over a preset fuel pressure to protect the accumulator and the pipe system (e.g. when the fuel system malfunctions or is disabled while the engine is running or when the fuel temperature goes up while the engine stops). To open this relief valve steadily or to prevent instantaneous opening of the relief valve when the engine is running, the accumulator is made bigger in the volume or an orifice is provided in part of the discharge passage and thus the instantaneous fuel pressure rise by the discharge of the fuel pump is made smaller than that at the discharge port of the fuel pump. This makes the discharge rate of the fuel pump approximately equal to the injection rate of the fuel injection valve, runs the fuel ump efficiently, and prevents the rise of fuel temperature due to the discharge of fuel from the relief valve.

As the fuel pump discharges fuel in proportion to the speed of rotation of the cam shaft, the fuel pump is equipped with a high-pressure regulator for regulating the fuel pressure in the accumulator approximately constant. Thereby, the discharge fuel exceeding the required quantity of engine flows from the high-pressure regulator to a fuel tank. The excess fuel discharged to the fuel tank is cooled in the fuel tank and fed to the fuel pump. This prevents reduction in the fuel discharge efficiency and durability of the fuel pump due to its temperature rise. If the accumulator temperature rises and consequently the fuel pressure is going to rise when the engine stops, the high-pressure regulator opens to prevent the accumulator and the pipe system against damages by excessive pressure. The fuel pump has a throttle member at the exit of the discharge passage, and high-pressure damper and a high-pressure regulator before it. This structure works to exhaust, from the high-pressure regulator, an instantaneous fuel volume increment caused by the throttle member provided at the exit of the discharge passage of the fuel pump, and thus prevents the high-pressure damper from receiving excessive volume changes.

The fuel pump disclosed by Japanese Application Patent Laid-Open Publication No. 2001-123912 has a relief valve in the accumulator and consequently requires an exhaust pipe which connects the accumulator and the fuel intake passage. This increases the production cost of the fuel pump. Further, in a conventional fuel pump, the high-pressure regulator can control at an approximately constant fuel pressure only. Even if a high-pressure regulator of the electromagnetic type or the like is employed to vary the fuel pressure control range, it is limited by the range of the pulsation attenuation fuel pressure of the high-pressure damper and cannot be made so wide.

From the above studies and considerations, we inventors determined some preferred embodiments.

(Embodiment 1)

Figure 2:
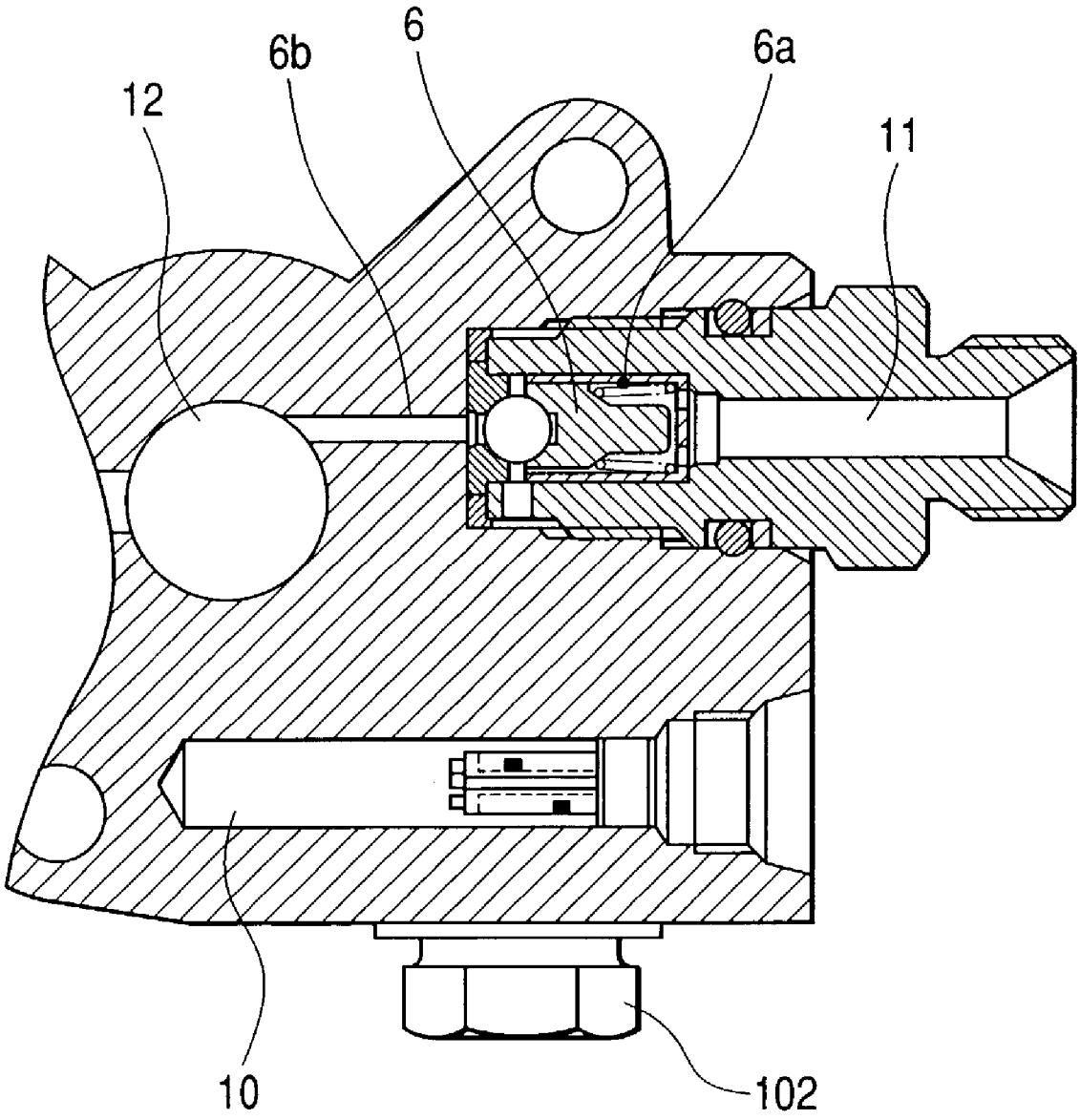
FIG. 2 is a horizontal sectional view of the fuel pump of FIG. 1 cut with a plane including the fuel intake passage and the discharge passage.
Figure 3:
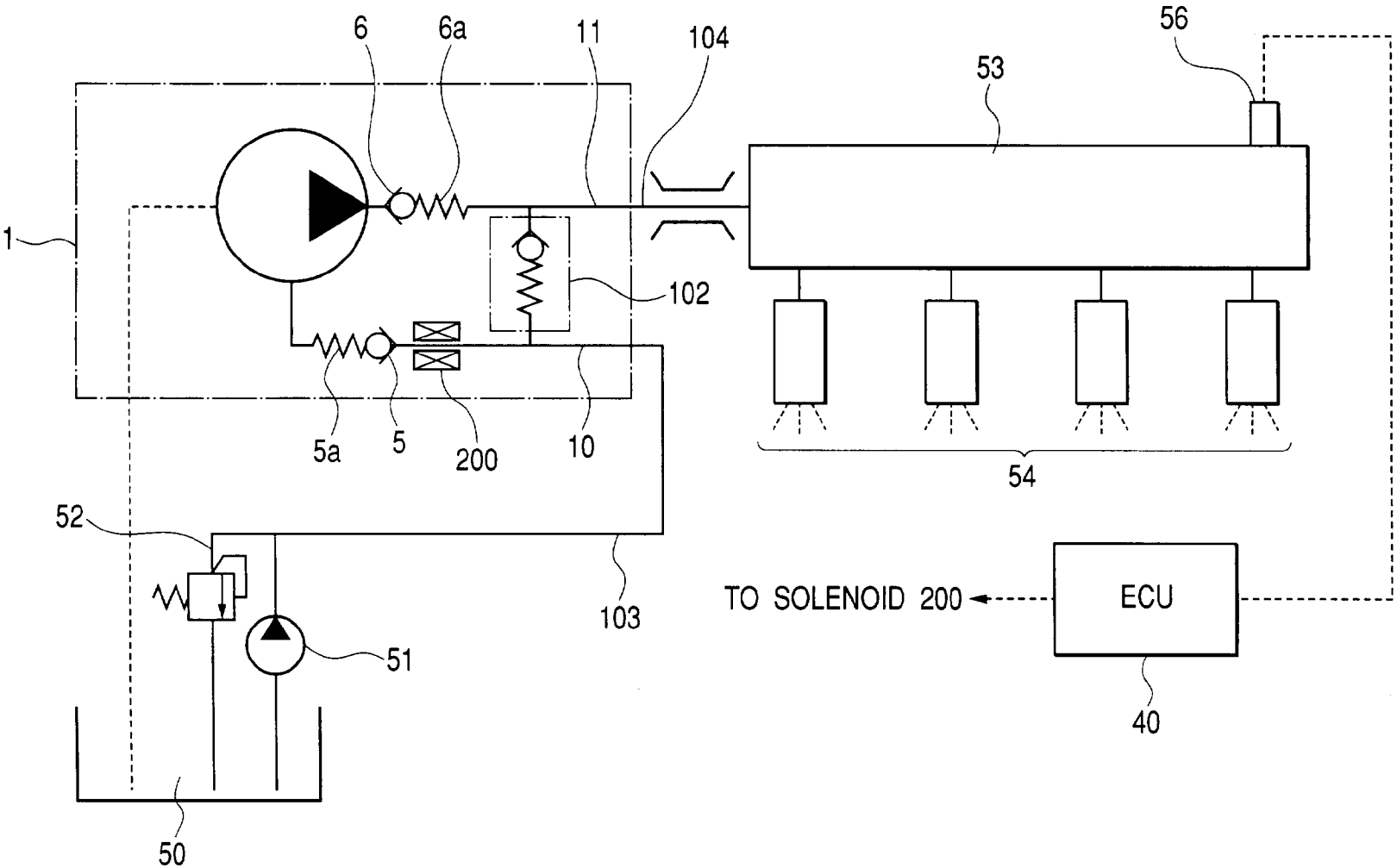
FIG. 3 is a block schematic diagram of the fuel injection system.

One preferred embodiment of the invention will be explained below referring to FIG. 1, FIG. 2 and FIG. 3. FIG. 1 is a vertical sectional view of the whole pump. FIG. 2 is a horizontal sectional view of the fuel intake passage 10 and the discharge passage 11 of the fuel pump in FIG. 1. FIG. 3 is a block schematic diagram of the fuel injection system. Part of the fuel intake passage 10 (shown in FIG. 2) is not shown in FIG. 1 as it is in a vertical section different from that of the discharge passage 11. In the description of embodiments, like reference numerals in figures represent the same or similar elements and their explanation may be omitted unless otherwise required.

The pump 1 contains a fuel intake passage 10, a discharge passage 11, and a pump chamber 12. The fuel intake passages 10 in FIG. 1 and FIG. 2 are connected with each other and work as a single fuel intake passage 10. The fuel intake passage 10 and the discharge passage 11 respectively have an intake valve 5 and a discharge valve 6. These valves are pressed in an identical direction respectively by springs 5*a* and 6*a* to limit the direction of fuel flow. In other words, the valves work as check valves. The pump chamber section 12 comprises a pump chamber 12, an intake hole 5*b* that connects with an intake valve 5 and a discharge hole 6*b* which connects with the discharge valve 6. The intake chamber 10*a* contains a solenoid 200 supported by the pump body 1. When the solenoid 200 is turned off, the intake valve 5 is open as shown in FIG. 1.

Mainly referring to FIG. 3, a flow of fuel to the engine is explained below. The fuel is transferred from the tank 50 to the fuel inlet of the pump body 1 through a low-pressure pipe 103 by a low-pressure pump 51. The fuel pressure is regulated constant by a low-pressure regulator 52. Then the fuel is pressurized by the pump body 1 and forcibly transferred from the fuel discharge port to the common rail 53 through a high-pressure pipe 104. The common rail 53 is equipped with injectors 54 and a pressure sensor 56. The injectors 54 as many as cylinders of the engine are provided and inject fuel by signals from an engine control unit (ECU) 40. A relief assembly 102 (singly termed as assembly 102 below) is provided on the pump body 1 and works to open to protect the pipe system when the pressure of the common rail 53 goes over a preset value.

Below will be explained the operation of the pump 1.

A lifter 3 at the lower end of the plunger 2 is pressed against a cam 100 by a spring 4. The plunger 2 is slidably held by the cylinder 20 and reciprocally moved to vary the volume in the pressurizing chamber 12 by the cam 100 which is driven by an engine camshaft. Further, at the lower end of the cylinder 20 is provided a plunger seal 30 to prevent the fuel from going into the cam 100 side.

When the intake valve 5 closes in a compression stroke of the plunger 2 (while the plunger is moving up in FIG. 1), the pressure in the pump chamber 12 goes up and the discharge valve 6 opens. With this, the fuel is forcibly transferred to the common rail 53 through the discharge passage 11.

The intake valve 5 automatically opens when the pressure in the pump chamber 12 goes below the pressure in the fuel inlet port but its closing is determined by the operation of the solenoid 200. In other words, while the solenoid 200 is on (powered), the solenoid 200 attracts the plunger rod 201 and as the result, the plunger rod 201 is separated from the intake valve 5. In this status, the intake valve 5 works as an automatic valve which opens and closes in synchronism with the reciprocal movement of the plunger 2. In a compression stroke, the intake valve 5 closes. The fuel equivalent to the decrement of volume in the pump chamber 12 forcibly opens the discharge valve 6 and is sent to the common rail 53.

Contrarily, while the solenoid 200 is off (not powered), the plunger rod 201 engages with the intake valve 5 and keeps the intake valve 5 open. As the result, the pressure in the pump chamber 12 is kept approximately as low as the pressure in the fuel inlet port also in the compression stroke. This keeps the discharge valve 6 closed and consequently, the fuel equivalent to the decrement of volume in the pump chamber 12 is returned to the fuel inlet port through the intake valve 5. When the solenoid 200 is turned on halfway in the compression stroke, the fuel is forcibly transferred to the common rail 53. Once the pressure-transfer of fuel starts, the internal pressure of the pump chamber 12 goes up. As the result, even when the solenoid 200 is turned off, the intake valve 5 keeps closed. The intake valve 5 automatically opens in synchronism with the beginning of the start of suction stroke.

Next the installation of the relief valve is explained below referring to FIG. 4, FIG. 5, and FIG. 6.

Figure 4:
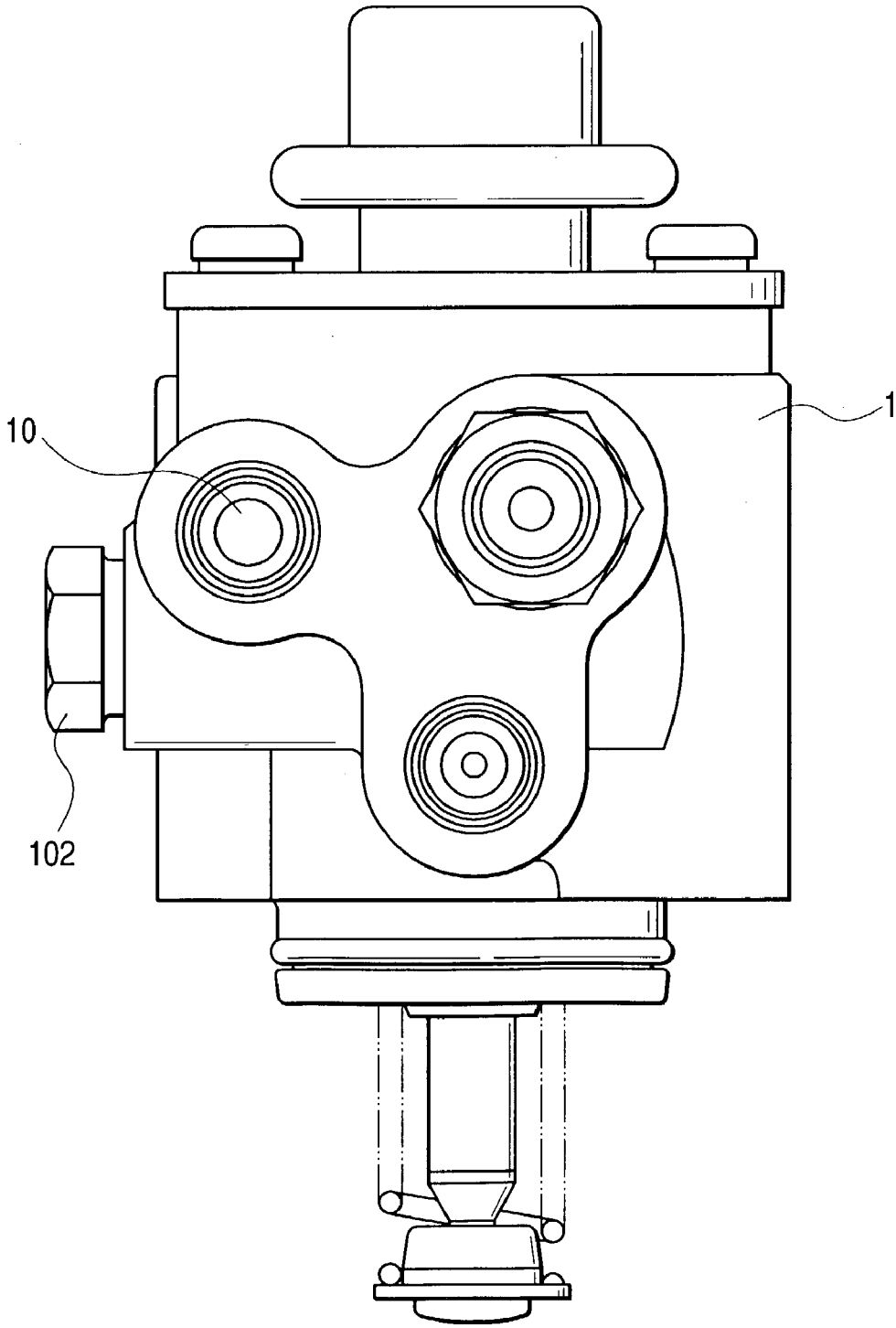
FIG. 4 is an external view of the fuel pump having a fuel intake port and a fuel discharge port.

FIG. 4 is an external view of the pump body with a fuel inlet port and a discharge port. FIG. 5 is a vertical sectional view of a relief assembly 102. FIG. 6 is a perspective view of FIG. 5. As illustrated in FIG. 2 and FIG. 3, this pump is equipped with a fuel intake passage 10 and a discharge passage 11 which run in parallel, a connecting passage 105 which is perpendicular to the fuel intake passage 10 and the discharge passage 11 to connect these passages, and a relief assembly 102 is provided in the connecting passage 105. The fuel is introduced from the discharge passage 11 to the connecting passage 105 through the intersection hole 11*b*. The relief assembly 102 is equipped with a valve seat 102*d* and a relief assembly 102*a* that opens when the fuel pressure goes above a preset pressure and a blind plug 301 that blocks the open end of the connecting passage 105. The relief assembly 102 also contains a fuel filter 302 to remove impurities from the fuel. The valve seat 102*d* is fastened by the threaded part 303 in the relief assembly 102 so that the opening pressure of the check valve 102*a* may be adjusted. In other words, the check valve 102*a* is supported by a spring 302. As the valve seat 102*d* is moved left (in FIG. 5) by the threaded part, the spring force goes higher and the valve opening pressure increases. Similarly, as the valve seat 102*d* is moved right, the valve opening pressure decreases.

A sealing material is applied to the threaded part 303 to prevent leakage of fuel from the threaded part 303. The discharge passage 11 and the fuel intake passage 10 are connected with each other through a relief assembly 102. When the fuel pressure in the common rail 53 goes over a preset pressure (the valve opening pressure of the check valve 102*a*), the valve opens to flow the fuel from the discharge passage 11 to the fuel intake passage 10 for protection of the pipe system against damages by an excessive pressure.

It is possible to provide a check valve 102*a* (by drilling in two directions) by providing the fuel intake passage 10 and the discharge passage 11 in almost parallel, forming a blind plug hole 301 perpendicularly to these passages, and placing the check valve 102*a* in the hole.

This can improve the workability of the pump body 1 in production and reduce its production cost. Further this can facilitate periodic maintenance of the relief valve and part replacement when the pump is in trouble.

The connecting passage 105 is sealed with sealing blocks 102*b* and 102*c* in the relief assembly 102. The sealing block

102*b* is in metallic contact with the pump body 1. This structure simplifies a high-pressure sealing structure. This sealing block divides the connecting passage 105 into two: a high-pressure section and a low-pressure section. The sealing block 102*c* is sealed by a rubber O-ring on the pump body 1. This sealing block prevents a fuel leak from the low-pressure section to the outside of the pump. This rubber O-ring assures sealing of the low-pressure sealing block.

By disposing the fuel intake passage 10 and the discharge passage 11 in almost parallel and placing a check valve 102*a* in the blind plug 301 which is formed perpendicular to the passages, you can provide a hole that connects the fuel intake passage and the discharge passage when the relief assembly 102 is mounted just by drilling a connecting passage 105. Further, a throttle section can be formed in the upstream side of the check valve 102*a* when the cross-section of the intersection hole 11*b* (flow passage) is made smaller than the cross-sections (flow passages) of the discharge passage 11 and the connecting passage 105. This can keep the fuel pump compact. This structure can be accomplished by a simple shape change and a simple modification of the pump.

Another embodiment is explained below referring to FIG. 7 and FIG. 8.

Figure 5:
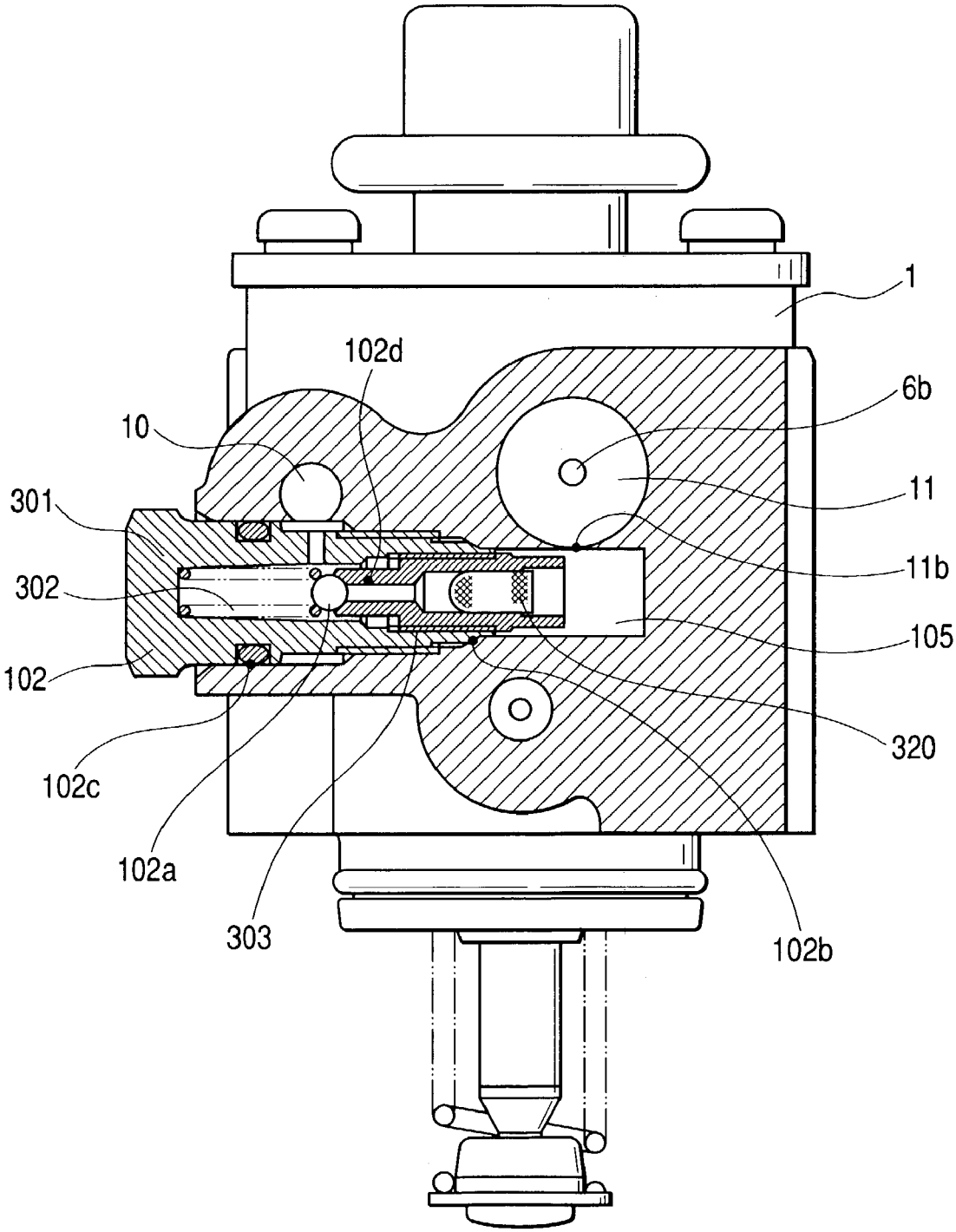
FIG. 5 is a vertical sectional view of the fuel pump cut with a plane including the relief valve.
Figure 6:
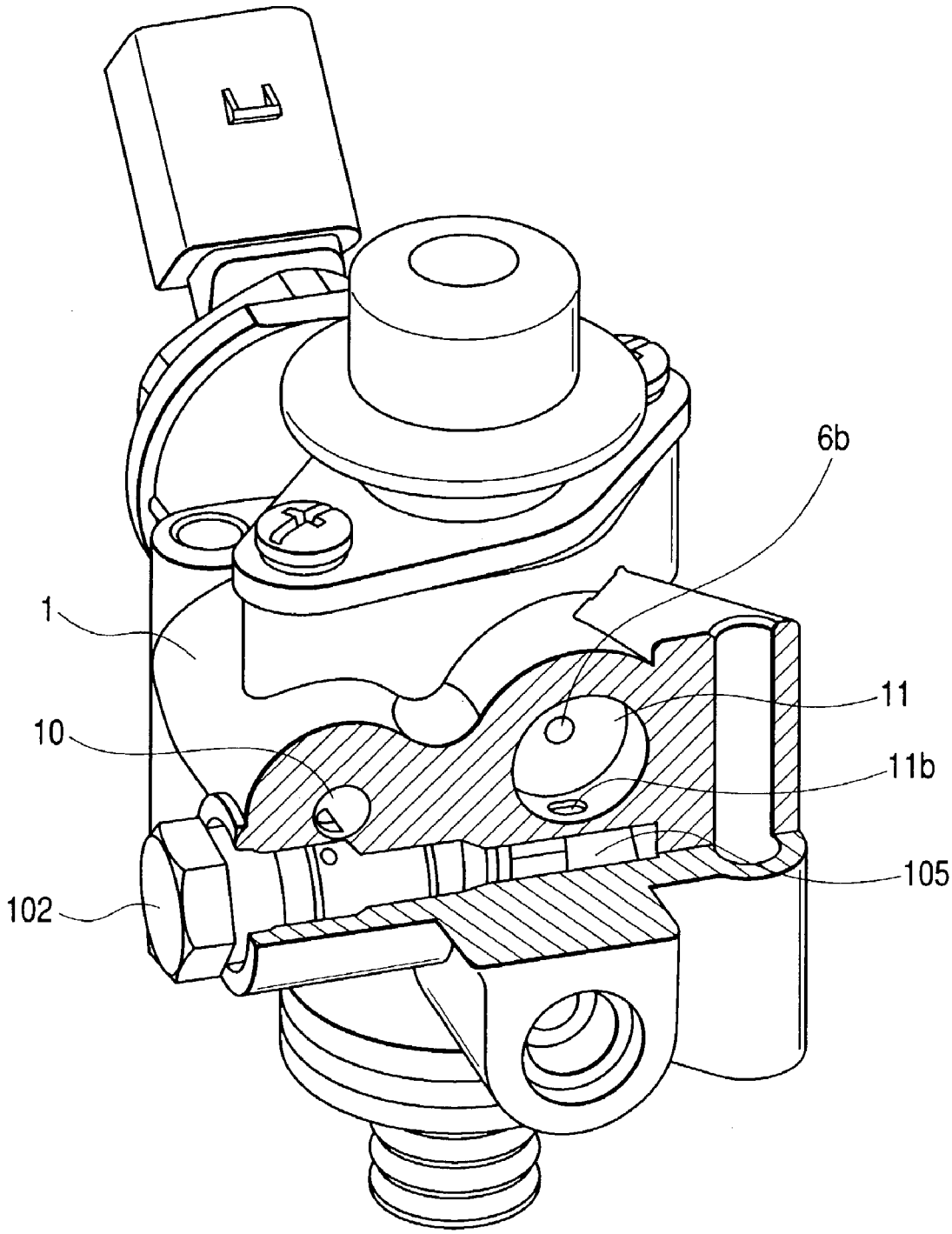
FIG. 6 is a partially-removed perspective view of the fuel pump of FIG. 5.
Figure 7:
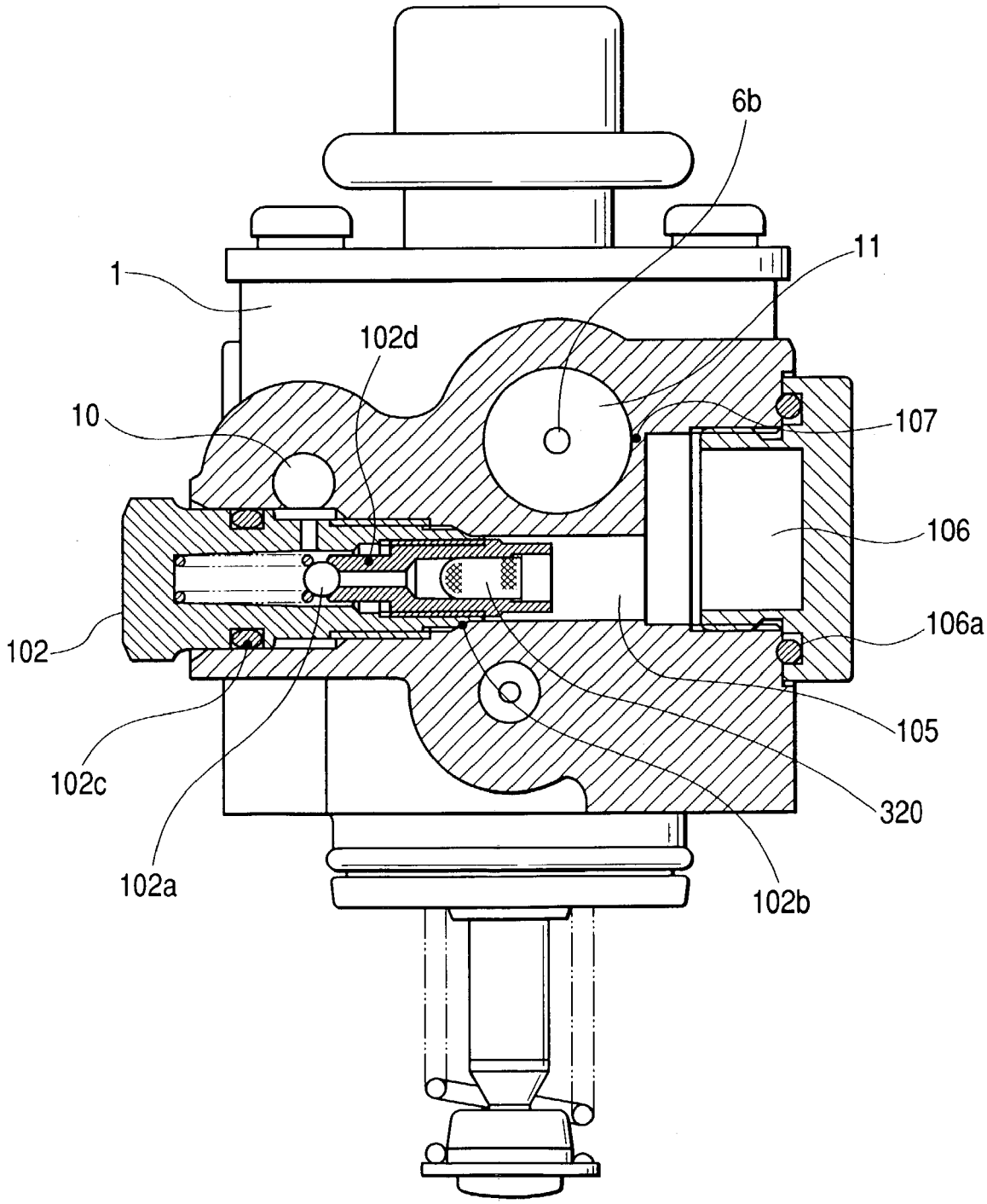
FIG. 7 is a vertical sectional view of a fuel pump which is a second embodiment of the present invention.
Figure 8:
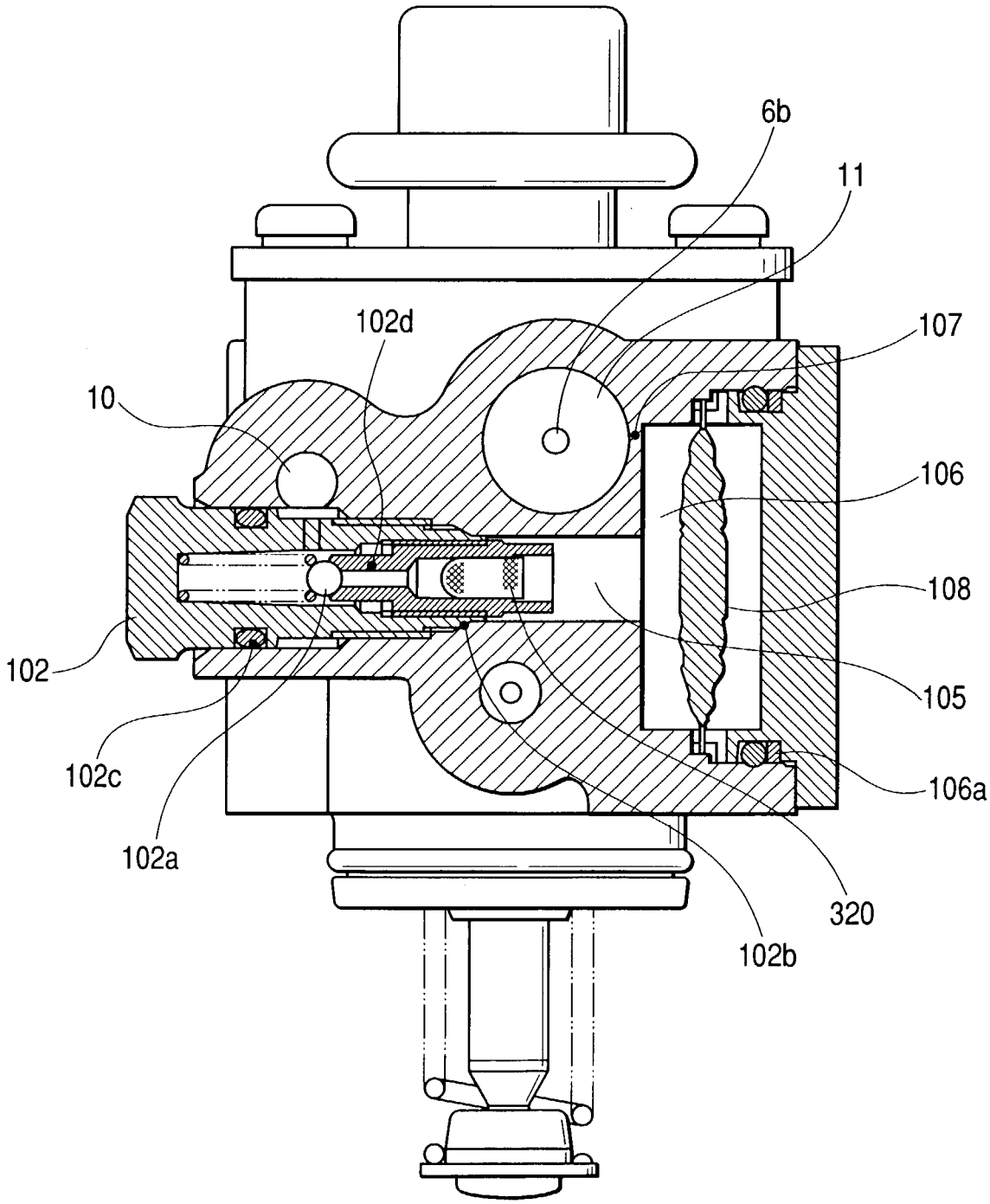
FIG. 8 is a vertical sectional view of a fuel pump which is a third embodiment of the present invention.
Figure 9:
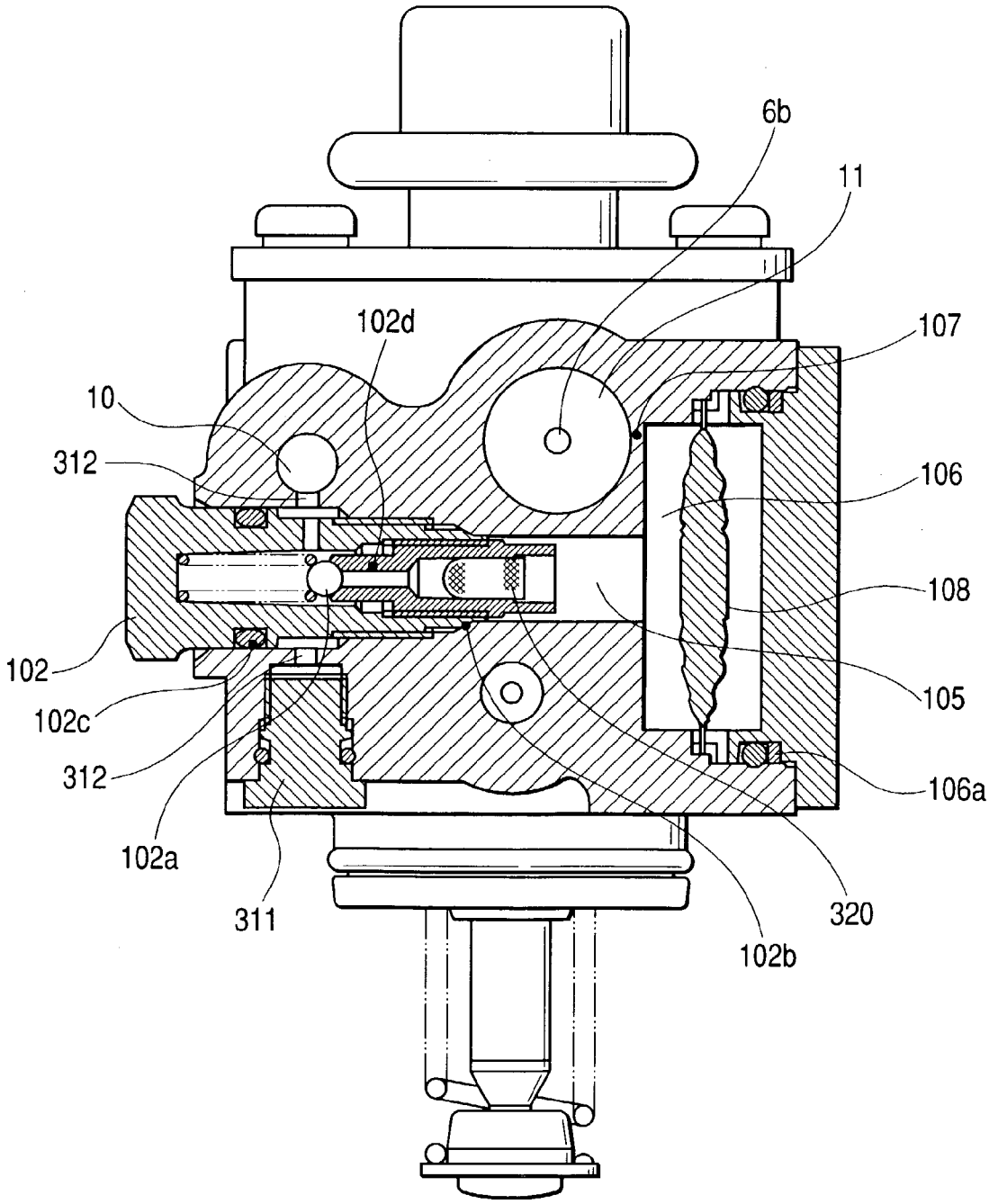
FIG. 9 is a vertical sectional view of a fuel pump which is any other embodiment of the present invention.

FIG. 7, FIG. 8, and FIG. 9 are cross-sectional views of the pump at the same viewing position as that of FIG. 5.

In FIG. 7, a fuel chamber 106 is provided between the discharge passage 11 and the relief assembly 102 and connected with the fuel chamber 106 through an orifice 107. In FIG. 8, the fuel pump has a damper 108 in the fuel chamber 106.

With these components, the instantaneous fuel pressure rise in the discharge passage 11 can be attenuated more effectively in the upstream side of the relief assembly 102. Further, in FIG. 8, the damper 108 can attenuate a fuel pressure rise. As the fuel pressure is stabilized in this way, even when the difference between the target mean fuel pressure and the relief valve opening pressure is small in the normal operation of the pump, it is possible to prevent the relief valve from opening and discharging part of the fuel discharge rate of the fuel pump. Therefore, the fuel pump need not have a greater volume than required by the engine and can be made compact. Further, the relief valve opening pressure can be made closer to the target mean fuel pressure in the normal operation, the relief valve can be made smaller and the resistant pressure of the piping system can be reduced. Furthermore, the relief valve can be less operated and the check valve can have a longer service life. Further, as the instantaneous fuel pressure rise of the fuel chamber 106 can be attenuated, the sealing reliability of the sealing block 106*a* can be increased even when the sealing block 106*a* uses a rubber O-ring as shown in this embodiment.

A solenoid 200 can be provided to regulate the rate of fuel which the fuel pump discharges. This can also facilitate non-returning of the high-pressure fuel, and shorten the fuel passage between the fuel tank and the fuel pump accumulator. This leads to reduction of the production cost, compactness of the system, and reduction in the number of joint parts, and thus increases the reliability of the fuel pump.

FIG. 9 shows an embodiment having an additional hole 312 for connecting the fuel intake passage 10 with the connecting passage 105. In this embodiment, the fuel intake passage 10 and the connecting passage 105 are formed apart from each other. A hole 312 is drilled from below to the fuel intake passage 10 across the connecting passage 105. This hole 312 connects the connecting passage 105 with the fuel intake passage 10. The lower end of the connecting hole 312 (opposite to the fuel intake passage 10) is blocked with a seal plug 311 having an O-ring.

As this can avoid circumferential communication of these two passages when they are connected with each other, machining problems such as burrs can be eliminated in the connecting parts. Further this can connect these two passages without fail even when a little machining error is made. Although this embodiment provides a passage for connecting the fuel intake passage with the connecting passage, it is possible to provide a passage connecting the discharge passage and the connecting passage that are in contact with each other. The same effect can be obtained in such as case.

The above embodiments can respectively go without an exhaust pipe. This can reduce the number of components, the production cost, the size, and the number of joints and thus offer a fuel pump that can constitute a high reliability fuel supply system.

A throttle member provided between the relief valve and the discharge passage attenuates an instantaneous fuel pressure rise (pulsation) in the discharge passage which occurs when the fuel pump discharges and thus stabilizes the fuel pressure in the upstream side (between the discharge passage and the throttle member) of the relief valve. Even when the difference between the target mean fuel pressure and the relief valve opening pressure is small in the normal operation of the pump, it is possible to prevent the relief valve from opening and discharging part of the fuel discharge rate of the fuel pump. Therefore, the fuel pump need not have a greater volume than required by the engine and can be made compact. Further, the relief valve opening pressure can be made closer to the target mean fuel pressure in the normal operation (as the valve opening pressure can be reduced), the relief valve can be made smaller and the resistant pressure of the piping system can be reduced. Furthermore, the relief valve can be less operated and the check valve can have a longer service life.

A throttle section can be formed in the upstream side of the check valve 102*a* when the connecting passage and the fuel intake passage are disposed with their center lines offset and intersected with each other and the cross-section of the intersection hole 11*b* (flow passage) is made smaller than the cross-sections (flow passages) of the discharge passage and the connecting passage. This can be formed by a simple machining. This can keep the fuel pump compact and reduce the production cost of the fuel pump.

Further, a fuel chamber made by expanding the flow passage between the throttle section and the relief valve will attenuate the fuel pressure pulsation in the upstream side of the relief valve more effectively. This can reduce the opening pressure of the relief valve Further, a damper provided between the throttle and relief valve can attenuate the fuel pressure pulsation in the upstream side of the relief valve more effectively. The throttle section can limit the increment of the instantaneous fuel volume made when the fuel pump discharges. These means can reduce an excessive volume change on the damper and increase the reliability of the damper and reduce the resistant pressure of the damper.

It is possible to improve the workability of the pump housing and reduce the production cost of the pump by open one end of the passage which connects the fuel intake passage and the discharge passage, inserting a blind plug into the opening end to block the flow passage, and providing a relief valve in the blind plug. Further this can facilitate periodic maintenance of the relief valve and part replacement when the pump is in trouble.

Further, two sealing blocks are provided in the blind plug. One of the sealing blocks is a metal contact seal (high-pressure sealing block) between the fuel intake passage and the discharge passage. The other is a rubber contact seal (low-pressure sealing block) between the fuel intake passage and the outside of the housing. This configuration can simplify the high-pressure seal and increase the reliability of the low-pressure sealing block.

The blind plug having the relief valve is placed on a point at which the center lines of the connecting passage and the fuel intake passage intersect with each other. This can make the fuel pump smaller.

Further, the fuel pump is equipped with a mechanism for metering the rate of discharged fuel and a relief valve in a passage which connects the front side of the intake valve with the rear side Off the discharge valve. This can also facilitate non-returning of the high-pressure fuel, and shorten the fuel passage connecting the fuel tank, the fuel pump, and the accumulator chamber. This leads to reduction of the production cost, compactness of the system, and reduction in the number of joint parts, and thus increases the reliability of the fuel pump.

(Effects of the Invention)

The present invention can provide a high-pressure fuel pump of a simplified structure.

What is claimed is:

1. A fuel pump comprising:

a cylinder formed in a pump body, a reciprocating plunger installed in the cylinder, a pressurizing chamber formed by the cylinder and the plunger, and whose internal volume varies with reciprocating motion of the plunger, a fuel intake passage for feeding fuel into the pressurizing chamber, a fuel discharge passage for feeding out the fuel pressured by the pressurizing chamber, a fuel intake valve provided in the fuel intake passage, and a fuel discharge valve provided in the fuel discharge passage, and a connecting passage for connecting between the upstream side of the intake valve in the fuel intake passage and the downstream side of the discharge valve in the fuel discharge passage, wherein the connecting passage is provided with a check valve for allowing the fuel to pass from the fuel discharge flow passage to the fuel intake passage, and the connecting passage is comprised of a check valve-mounting hole which is bored into the pump body from an outer surface of the pump body.

2. The fuel pump of claim 1, wherein said check valve works as a relief valve that allows the fuel to pass from said fuel discharge passage to said fuel intake passage when the fuel pressure in the fuel discharge passage exceeds a preset value.

3. The fuel pump of claim 1, wherein said pump contains a joint of said fuel intake passage and said connecting passage and a joint of said fuel discharge passage and said connecting passage, and the joints are located inside of said pump body.

4. The fuel pump of claim 3, wherein said fuel intake passage, said fuel discharge passage, and said connecting passage are provided in an identical metal or a plastic block.

5. The fuel pump of claim 1, wherein said fuel intake passage and said fuel discharge passage are placed in parallel to each other; a connecting passage is provided approximately perpendicularly to these passages to connect these passages with each other; and said check valve works as a relief valve for the discharged passage pressure relief.

6. The fuel pump of claim 1, wherein an orifice is provided in a flow passage between said fuel discharge passage and said check valve.

7. The fuel pump of claim 6, wherein a fuel chamber to be part of a flow passage is provided between said orifice and said relief valve.

8. The fuel pump of claim 6, wherein a damper whose volume varies by fuel pressure is provided in contact with fuel between said orifice and said relief valve.

9. The fuel pump of claim 1, wherein both ends of said connecting passage are provided with plug-mounting holes on the outer surface of the pump body; one of said plug-mounting holes is equipped with a first blind plug for preventing fuel from flowing out from said connecting passage to the outside of the pump; another thereof is equipped with a second blind plug, said check valve serving as a relief valve, and a sealing section for blocking fuel passage between the intake side and the discharge side except the place of said relief valve.

10. The fuel pump of claim 9, wherein said first blind plug and said second blind plug are mounted in a single body as said pump body.

11. The fuel pump of claim 9, wherein the sealing section of said first blind plug is a rubber contact seal and the sealing section of said second blind plug is a metal contact seal.

12. The fuel pump of claim 5, wherein said connecting passage and said fuel intake passage are disposed with their center lines offset and intersected with each other, and said check valve is placed on the intersection of said passages.

13. A fuel pump comprising a fuel intake passage, a fuel discharge passage, a fuel intake valve provided in said fuel intake passage, a fuel discharge valve provided in said discharge passage, a pressurizing chamber provided between said intake valve and said discharge valve, a mechanism for metering fuel discharged from said pressurizing chamber, and a connecting passage provided between the upstream side of said fuel intake valve and the downstream side of said discharge valve, wherein the connecting passage is provided with a relief valve for allowing the fuel from the fuel discharge valve to the fuel intake valve, and the connecting passage is comprised of a relief valve-mounting hole which is bored into the pump body from an outer surface of the pump body.

14. The fuel pump of claim 10, wherein the sealing section of said first blind plug is a rubber contact seal and the sealing section of said second blind plug is a metal contact seal.

15. A fuel pump comprising:

a cylinder formed in a pump body, a reciprocating plunger installed in the cylinder, a pressurizing chamber formed by the cylinder and the plunger, and whose internal volume varies with the reciprocating motion of the plunger, a fuel intake passage for feeding fuel into the pressurizing chamber, a fuel discharge passage for feeding out the fuel pressurized by the pressurizing chamber, a fuel intake valve provided in the fuel intake passage, a fuel discharge valve provided in the fuel discharge passage, and a connecting passage for connecting between the upstream side of the fuel intake valve in the fuel intake passage and the downstream side of the fuel discharge valve in the fuel discharge passage, wherein the connecting passage is provided with a check valve for allowing the fuel to pass from the fuel discharge valve to the fuel intake valve, and wherein both ends of said connecting passage are provided with plug-mounting holes on the outer surface of the pump body; one of the said plug-mounting holes is equipped with a first blind plug for preventing fuel from flowing out from said connecting passage to the outside of the pump; another thereof is equipped with a second blind plug, said check valve serving as a relief valve for the discharged passage pressure relief, and a sealing section for blocking fuel passage between the intake side and the discharge side except the place of said relief valve.

16. A fuel pump comprising:

a cylinder formed in a pump body, a reciprocating plunger installed in the cylinder, a pressurizing chamber formed by the cylinder and the plunger, and whose internal volume varies with reciprocating motion of the plunger, a fuel intake passage for feeding fuel into the pressurizing chamber, a fuel discharge passage for feeding out the fuel pressurized by the pressurizing chamber, a fuel intake valve provided in the fuel intake passage, and a fuel discharge valve provided in the fuel discharge passage, and a connecting passage for connecting between the upstream side of the fuel intake valve in the fuel intake passage and the downstream side of the fuel discharge valve in the fuel discharge passage, wherein the connecting passage is provided with a check valve for allowing the fuel to pass from the fuel discharge valve to the fuel intake valve, wherein both ends of said connecting passage are provided with plug-mounting holes on the outer surface of the pump body; one of said plug-mounting holes is equipped with a first blind plug for preventing fuel from flowing out from said connecting passage to the outside of the pump; another thereof is equipped with a second blind plug, said check valve serving as a relief valve for the discharged passage pressure relief, and a sealing section for blocking fuel passage between the intake side and the discharge side except the place of said relief valve, and wherein said first blind plug and said second blind plug are mounted in a single body as said pump body.

17. The fuel pump of claim 15, wherein the sealing section of said first blind plug is a rubber contact seal and the sealing section of said second blind plug is a metal contact seal.

18. The fuel pump of claim 16, wherein the sealing section of said first blind plug is as rubber contact seal and the sealing section of said second blind plug is a metal contact seal.

* * * * *